US006516893B2

(12) United States Patent
Pahila

(10) Patent No.: US 6,516,893 B2
(45) Date of Patent: Feb. 11, 2003

(54) RESIDENTIAL SPRINKLER ARRANGEMENT

(75) Inventor: Oliver S. Pahila, Mount Vernon, NY (US)

(73) Assignee: The Reliable Automatic Sprinkler Co.,Inc., Elmsford, NY (US)

( * ) Notice: Subject to any disclaimer, the term of this patent is extended or adjusted under 35 U.S.C. 154(b) by 57 days.

(21) Appl. No.: 09/874,428

(22) Filed: Jun. 5, 2001

(65) Prior Publication Data

US 2002/0185548 A1 Dec. 12, 2002

(51) Int. Cl.[7] ..... A62C 37/08; B05B 1/26
(52) U.S. Cl. ..... 169/37; 239/498
(58) Field of Search ..... 169/37; 239/522, 239/521, 498

(56) References Cited

U.S. PATENT DOCUMENTS 5,366,022 A 11/1994 Meyer et al.
5,579,846 A 12/1996 Meyer et al.
5,839,667 A 11/1998 Fishcer
5,862,994 A 1/1999 Pounder et al.
5,865,256 A 2/1999 Pounder
6,026,907 A * 2/2000 Pahila ..... 169/37
6,059,044 A 5/2000 Fishcer
6,276,460 B1 * 8/2001 Pahila ..... 169/37

* cited by examiner

*Primary Examiner*—Lesley D. Morris
(74) *Attorney, Agent, or Firm*—Baker Botts, LLP

(57) ABSTRACT

In the particular embodiments disclosed in the specification, a residential sprinkler arrangement includes a sprinkler body with an axial passage having an outlet opening providing a K factor of about 4 to about 6 which is normally closed by a cap retained in position by a thermally responsive element and a planar deflector spaced from the outlet opening and supported from the sprinkler body by a pair of frame arms. The deflector has a circumferential array of peripheral slots, a first set of which, located in the plane of the frame arms, has a length greater than that of any of the other slot-like openings and a second set of which, located in the plane perpendicular of the plane of the frame arms, has a length less than that of the first set but greater than that of any of the other slots. A third set of four slots, located at 45° to the plane of the frame arms, has a length less than that of the second set but greater than that of a fourth set of eight slots which are located at about 13° from each of the plane of the frame arms and the plane perpendicular to the plane of the frame arms and a fifth set of slots, located between the slots of the third and fourth sets extends substantially parallel to the slots of the third set of the slots.

27 Claims, 2 Drawing Sheets

RESIDENTIAL SPRINKLER ARRANGEMENT

BACKGROUND OF THE INVENTION

The invention relates to residential sprinkler arrangements and, more particularly, to residential sprinkler arrangements satisfying minimum flow rate, pressure and density requirements.

The proposed amendments to the National Fire Protection Association standards NFPA 13D and 13R for residential sprinklers require minimum density of 0.05 gallon per minute per square foot over the area to be protected. In addition, the Underwriters Laboratories revised Standard UL1626 for residential sprinklers requires minimum flow rate of 8, 10, 13, 17 and 20 gallons per minute to protect areas of 144, 196, 256, 324 and 400 square feet, respectively, at a minimum pressure of 7 psi. In order to meet these standards at the lowest required pressure and flow rates, the density distribution of water over the area to be protected by the sprinklers should be substantially uniform.

Various sprinkler arrangements and deflector designs have been proposed heretofore to provide desired water flow rate and distribution patterns at various pressures. For example, the Bosio et al. U.S. Pat. No. 5,687,914 discloses a sprinkler arrangement having a deflector supported from a pair of frame arms which has enlarged tines in the plane of the frame arms with their inner ends bent away from the frame arms and their outer ends inclined slightly toward the frame arms. The Grinnell Model F680 sprinkler has a planar deflector with keyhole-shaped slots distributed around the periphery with the circular part of the keyhole for slots in the plane of the frame arms having a diameter smaller than that of the other slots. Those arrangements, however, do not provide the desired water distribution uniformity for flow rates and pressures of the type mentioned above for residential sprinklers. The Pahila U.S. Pat. No. 6,026,907 discloses one form of residential sprinkler intended to satisfy certain water flow rate and uniformity requirements.

SUMMARY OF THE INVENTION

Accordingly, it is an object of the present invention to provide a residential sprinkler arrangement which overcomes disadvantages of the prior art.

Another object of the invention is to provide a residential sprinkler arrangement providing highly uniform water distribution at the minimum required flow rates and pressures for various areas to be protected.

These and other objects of the invention are attained by providing a sprinkler including a sprinkler body with a passage having an outlet opening which is normally closed by a cap retained in position by a thermally responsive element and a deflector spaced from the outlet opening and supported from the sprinkler body by a pair of arms and disposed generally in a plane perpendicular to the axis of the passage, in which the sprinkler has a K factor in the range from about 4 to about 6, preferably about 5, and desirably about 4.9. In addition, the deflector has a central portion and a peripheral portion with a circumferential array of tines in the peripheral portion separated by slot-like openings including a first set of slot-like openings consisting of two slots located in the plane of the frame arms which are longer than the other slot-like openings and a second set of slot-like openings consisting of two slots in the plane perpendicular to the planes of the frame arms which are longer than the remaining slot-like openings.

The deflector preferably includes a third set of slot-like openings consisting of four slots located at about 40° to about 50°, preferably about 45°, to those planes, a fourth set of slot-like openings includes eight slots which are shorter than all of the other slots and are located at about 11° to about 15°, desirably about 13°, on each side of each of the plane of the frame arms and the plane perpendicular thereto, and a fifth set of slot-like openings, including eight slots each located between a slot of the fourth set and the adjacent slot of the third set and extending approximately parallel to the slots of the third set.

Preferably the deflector has a planar shape and the first, second, third and fourth sets of slots extend substantially radially inwardly from the perimeter. In a preferred embodiment the deflector has a diameter of about 1.1 to 1.4 inches, preferably about 1.25 inches, and the slots of the first set have a length of about 0.27 to about 0.31 inch, desirably about 0.29 inches and the slots of the second set have a length of about 0.23 to 0.27 inch, desirably about 0.25 inch, while the slots of the third set have a length of about 0.16 to 0.20 inch, desirably about 0.18 inch and the slots of the fourth set have a length of about 0.08 to 0.12 inch, desirably about 0.1 inch.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
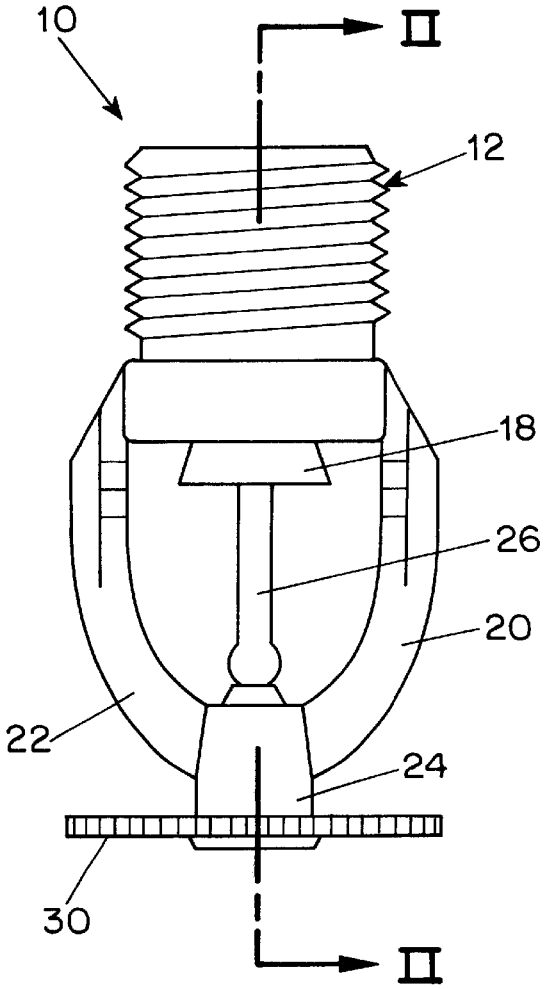
FIG. 1 is a side view illustrating a representative embodiment of a sprinkler arrangement according to the invention.
Figure 2:
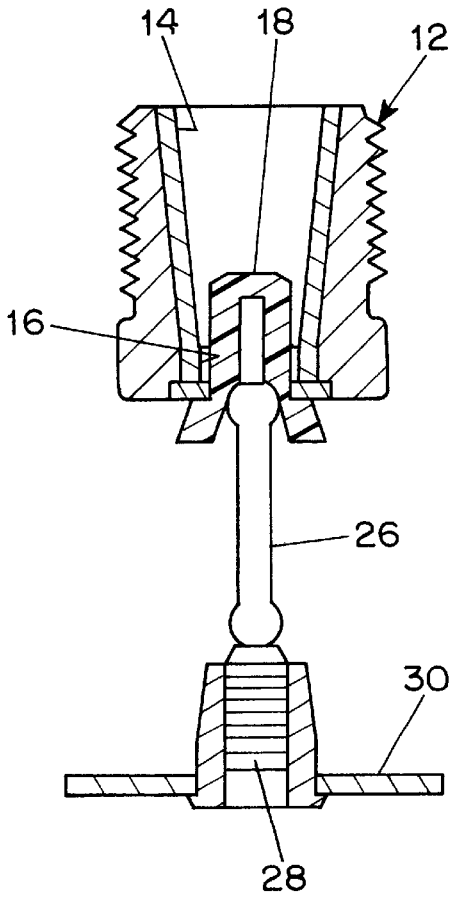
FIG. 2 is a longitudinal sectional view of the sprinkler arrangement shown in FIG. 1, taken on the line II—II therein and looking in the direction of the arrows.
Figure 3:
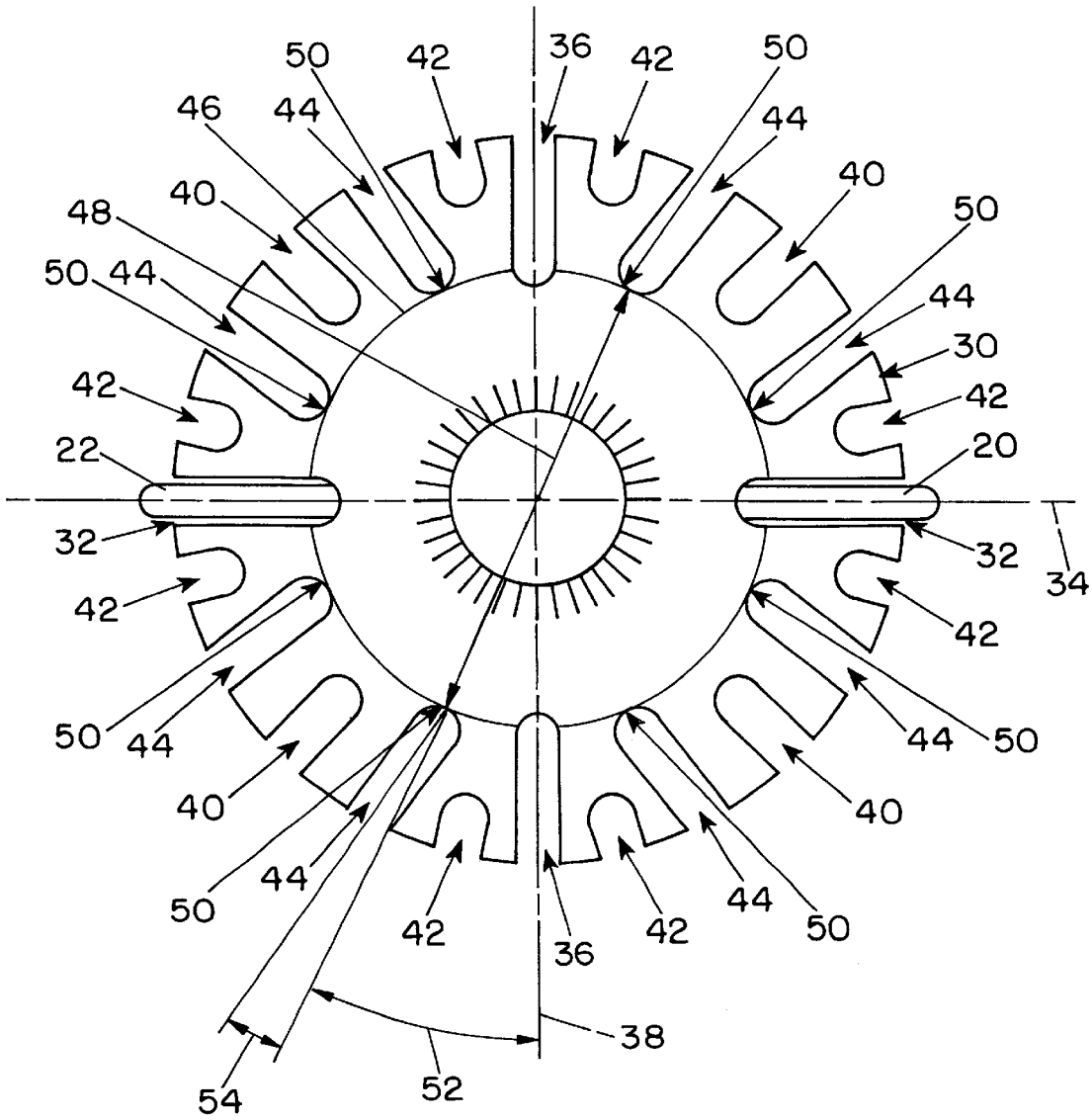
FIG. 3 is an end view illustrating the deflector used in the embodiment shown in FIGS. 1 and 2.

In the typical embodiment of the invention shown in the drawings, a sprinkler arrangement 10 has a threaded body 12 adapted to be connected to a water supply pipe with an axial passage 14 terminating in an orifice 16 which is normally closed by a cap 18. The sprinkler body 12 has a pair of frame arms 20 and 22 extending away from the orifice 16 in the plane of the sprinkler axis and terminating in a boss 24. To normally retain the cap 18 in its sealing position in the orifice 16 preventing water in the passage 14 from being released, a thermally responsive element 26 is positioned between a screw 28 threaded in the boss 24 and the cap 18.

To provide a fast response, the thermally responsive element 26 is preferably a glass bulb which is set to break when heated to a temperature of about 155° F., permitting pressurized water in the passage 14 to force the cap 18 out of the orifice 16 and release a stream of water through the orifice. The water passing through the orifice is distributed over an area to be protected by a deflector 30 which is mounted on the boss 24 and is disposed in a plane perpendicular to the axis of the passage 14. To assure adequate flow rates at the required minimum pressure of 7 psi, the size of the orifice 16 is selected to provide a K factor of about 4 to about 6, preferably about 5, and desirably 4.9.

In a typical embodiment of the invention the deflector 30, which has a diameter of about 1.1 to 1.4 inches and desirably about 1.25 inches, has a central portion surrounded by a peripheral portion containing an array of slot-like openings which includes a first set of two diametrically opposed slots 32 located in the plane 34 of the frame arms with a length of preferably about 0.27 inch to about 0.31 inch and desirably about 0.29 inch, a second set of two diametrically opposed slots 36 located in the plane 38 perpendicular to the plane of the frame arms and having a length of preferably about 0.23 inch to about 0.27 inch, and desirably about 0.25 inch, and a third set of four slots 40 located at about 40° to about 50°, desirably 45°, to the plane of the frame arms and having a length of preferably about 0.16 inch to about 0.20 inch, desirably about 0.18 inch.

The deflector also has a fourth set of eight slots 42 having a length of preferably about 0.08 inch to about 0.12 inch and desirably about 0.1 inch located at angles of about 11° to about 15°, preferably about 13° from the plane of the frame arms or the plane perpendicular thereto, respectively. In addition, the deflector has a fifth set of eight slots 44 which extend outwardly from a root diameter circle 46 having a diameter 48 of about 0.7 inch to about 0.9 inch and preferably about 0.8 inch starting at selected locations 50 which are at an angle 52 of preferably about 20° to about 25°, desirably about 22.5° from the plane 34 of the frame arms or the plane 38 perpendicular to the plane of the frame arms, respectively, and each of those slots extends approximately parallel to the slots of the third set, preferably at an angle 54 of about 10° to 20°, desirably about 15° from the radius of the deflector to the selected point 50 so that it is inclined toward the adjacent slot of the third set located at about 45° from the plane of the frame arms.

With this arrangement, the sprinkler of the invention has been found to provide substantially uniform density distribution for the room sizes listed in Table 1 below at the indicated flow rates and pressures:

TABLE I

| Room Size (ft. × ft.) | Flow Rate (gpm) | Pressure (psi) |
|---|---|---|
| 12 × 12 | 13 | 7.03 |
| 14 × 14 | 13 | 7.03 |
| 16 × 16 | 13 | 7.03 |
| 18 × 18 | 17 | 12.03 |
| 20 × 20 | 20 | 16.66 |

Thus, the sprinkler of the invention is capable of assuring density distribution in accordance with the requirements of the new NFPA and UL standards for residential sprinklers at minimum flow rates and pressures.

Although the invention has been described herein with reference to specific embodiments, many modifications and variations therein will really occur to those skilled in the art. Accordingly, all such variations and modifications are included within the intended scope of the invention.

I claim:

1. A residential sprinkler arrangement comprising:

a sprinkler body having an axial passage for delivery of fire extinguishing fluid providing a K factor in a range from about 4 to about 6;

a pair of frame arms extending from the sprinkler body in a plane generally parallel to the sprinkler axis; and a deflector supported by the pair of arms and disposed generally in a plane perpendicular to the axis of the sprinkler body and having a central portion and a peripheral portion containing an array of slot-like openings;

the slot-like openings including a first set of diametrically opposed slots in the plane of the frame arms which are longer than the rest of the slot-like openings and a second set of diametrically opposed slots in a plane perpendicular to the plane of frame arms which are shorter than the first set of openings but longer than the remainder of the slot-like openings in the deflector.

2. A residential sprinkler arrangement according to claim 1 wherein the array of slot-like openings includes a third set of four slots each located at an angle of about 40° to about 50° to the plane of the frame arms and having a length which is shorter than that of the slots in the first and second sets of slot-like openings.

3. A residential sprinkler arrangement according to claim 2 wherein each slot in the third set of slots is located at an angle of about 45° from the plane of the frame arms.

4. A residential sprinkler arrangement according to claim 2 wherein the array of slot-like openings includes a fourth set of eight slots having a length which is shorter than all of the other slot-like openings in the array, each slot of the fourth set being located at an angle of about 11° to about 15° to the plane of the frame arms or to the plane perpendicular thereto.

5. A residential sprinkler arrangement according to claim 4 wherein each of the slots of the fourth set is located at an angle of about 13° to the plane of the frame arms or to the plane perpendicular thereto.

6. A residential sprinkler arrangement according to claim 4 wherein the array of slot-like openings includes a fifth set of eight slots located between the slots of the third and fourth sets and extending approximately parallel to the slots of the third set.

7. A residential sprinkler arrangement according to claim 6 wherein the slots of the fifth set extend from selected locations on a root diameter circle which are at about 20° to about 25° from the plane of the frame arms or the plane perpendicular thereto and extend at an angle of about 10° to about 20° from the radius to the selected location toward the adjacent slot of the third set.

8. A residential sprinkler arrangement according to claim 7 wherein the selected locations on the root diameter circle are at an angle of about 22.5° from the plane of the frame arms or the plane perpendicular thereto.

9. A residential sprinkler arrangement according to claim 1 wherein the deflector has a diameter in a range from about 1.1 inch to about 1.4 inch.

10. A sprinkler arrangement according to claim 9 wherein the deflector has a diameter of about 1.25 inch.

11. A sprinkler arrangement according to claim 1 wherein the slots of the first set have a length in a range from about 0.27 inch to about 0.31 inch.

12. A residential sprinkler arrangement according to claim 11 wherein the slots of the first set have a length of about 0.29 inch.

13. A residential sprinkler arrangement according to claim 1 wherein the slots of the second set have a length in the range from about 0.23 inch to about 0.27 inch.

14. A residential sprinkler arrangement according to claim 13 wherein the slots of the second set have a length of about 0.25 inch.

15. A residential sprinkler arrangement according to claim 2 wherein the deflector has a diameter in a range from about 1.1 inch to about 1.4 inch and the slots of the third set have a length in a range from about 0.16 inch to about 0.20 inch.

16. A residential sprinkler arrangement according to claim 15 wherein the slots of the third set have a length of about 0.18 inch.

17. A residential sprinkler arrangement according to claim 3 wherein the deflector has a diameter in a range from about 1.1 inch to about 1.4 inch and the slots of the fourth set have a length in a range from about 0.08 inch to about 0.12 inch.

18. A residential sprinkler arrangement according to claim 17 wherein the slots of the fourth set have a length of about 0.1 inch.

19. A residential sprinkler arrangement according to claim 7 wherein the deflector has a diameter in a range from about 1.1 inch to about 1.4 inch and the root diameter circle has a diameter in a range from about 0.7 inch to about 0.9 inch.

20. A residential sprinkler arrangement according to claim 19 wherein the root diameter circle has a diameter of about 0.8 inches.

21. A residential sprinkler arrangement according to claim 7 in which the slots of the fifth set extend at an angle between about 10° and about 20° from the plane of the frame arms or from the plane perpendicular to the plane of the frame arms.

22. A residential sprinkler arrangement according to claim 21 wherein the slots of the fifth set extend at an angle of about 15° from the plane of the frame arms or from the plane perpendicular to the plane of the frame arms.

23. A residential sprinkler arrangement according to claim 1 wherein the deflector has a substantially planar configuration.

24. A residential sprinkler arrangement according to claim 1 wherein the sprinkler body has an axial passage providing a K factor of about 5.

25. A residential sprinkler arrangement according to claim 1 wherein the sprinkler arrangement provides substantially uniform density distribution at a flow rate of about 13 gallons per minute and a pressure of about 7 lbs. per square inch for protected areas up to about 16 ft.×16 ft.

26. A residential sprinkler arrangement according to claim 1 wherein the sprinkler arrangement provides substantially uniform density distribution at a flow rate of about 17 gallons per minute and a pressure of about 12 pounds per square inch for a protected area of about 18 ft.×18 ft.

27. A residential sprinkler arrangement according to claim 1 wherein the sprinkler arrangement provides substantially uniform density distribution at a flow rate of about 20 gallons per minute and a pressure of about 16 pounds per square inch for a protected area of about 20 ft.×20 ft.

* * * * *